US007967688B2

(12) United States Patent
Lai et al.

(10) Patent No.: US 7,967,688 B2
(45) Date of Patent: Jun. 28, 2011

(54) MOTION SIMULATOR

(75) Inventors: Deng-Horng Lai, Kaohsiung (TW); Ke-Cheng Chien, Linyuan Hsiang (TW)

(73) Assignees: Brogent Technologies, Inc. (TW); Deng-Horng Lai (TW); Ke-Cheng Chien (TW)

( * ) Notice: Subject to any disclaimer, the term of this patent is extended or adjusted under 35 U.S.C. 154(b) by 198 days.

(21) Appl. No.: 12/355,651

(22) Filed: Jan. 16, 2009

(65) Prior Publication Data

US 2010/0184524 A1 Jul. 22, 2010

(51) Int. Cl.
*A63G 1/34* (2006.01)
*A63G 1/00* (2006.01)

(52) U.S. Cl. ..... 472/43; 472/59; 472/130; 434/58

(58) Field of Classification Search ..... 472/43, 472/55, 59–61, 130; 434/29, 55, 58; 104/53, 104/83, 85, 154
See application file for complete search history.

(56) References Cited

U.S. PATENT DOCUMENTS 3,295,224 A 1/1967 Cappel
5,558,582 A * 9/1996 Swensen et al. ..... 472/43
6,095,926 A * 8/2000 Hettema et al. ..... 472/59
6,592,374 B1 * 7/2003 Kim ..... 434/58
7,033,177 B2 * 4/2006 Kim ..... 434/58
2003/0224333 A1 12/2003 Vastvedt

FOREIGN PATENT DOCUMENTS

WO WO 99/56846 11/1999

OTHER PUBLICATIONS

Schneider, "Motion Bases are Ready for Careers in Entertainment", Hydraulics and Pneumatics, US, vol. 51, No. 7, Jul. 1, 1998, Penton Media, Cleveland OH.
European Search Report, mailed Jul. 31, 2009.

* cited by examiner

*Primary Examiner* — Kien T Nguyen
(74) *Attorney, Agent, or Firm* — Hershkovitz & Associates, LLC; Abe Hershkovitz

(57) ABSTRACT

A motion simulator has a motive device suspended in midair and having a base, a moving panel, twelve universal joints mounted on the base and the moving panel and six actuators connected to the universal joints and being retractable. A seat assembly is hung on the moving panel. Therefore, as the actuators retract, the seat assembly is moved in six degrees of freedom such as heave, sway, surge, pitch, roll and yaw. Audiences sitting on the seat assembly are hung with their feet hanging in the air and therefore feel excited and experience vivid virtual reality. Moreover, the actuators bear axial force such as drag force and thrust force and are endurable and safety.

11 Claims, 12 Drawing Sheets

MOTION SIMULATOR

BACKGROUND OF THE INVENTION

1. Field of the Invention

The present invention relates to a motion simulator, especially to a motion simulator that has a seat being hung on a motive device to allow the seat to move in six degrees of freedom.

2. Description of the Prior Arts

Among amusement facilities in an amusement park, a synchronizing movie theater which is different from an ordinary movie theater is famous for providing a combined visual and motion experience. In the synchronizing movie theater, multiple motion simulators are arranged in front of a projection screen. The motion simulators synchronize with stories of movies, so that audiences sit on the motion simulators to experience virtual reality.

A conventional motion simulator comprises a base, multiple seats and a motive device. The seats are mounted on a top of the base for the audiences to sit. The motive device is mounted on a bottom of the base, drives the base, the seats and the audiences to move in four degrees of freedom, such as surge, heave, pitch or roll according to the stories of the movies. Therefore, the audiences feel like being in the movies.

With reference to FIGS. 11 and 12, another improved conventional motion simulators (50) comprises two arms (53) (only shown one arm), multiple mounting shafts (52) and multiple seats (51). The arms (53) parallel to each other. Each arm (53) has a pivot end and a lifting end. The pivot end of the arm (53) corresponds to the pivot end of the other arm (53) and is pivotally mounted to a wall of the movie theater. The mounting shafts (52) are connected rotatably between the arms (53). The seats (51) are pivotally mounted on the mounting shafts (52).

When the audiences sit on the seats (51), the lifting ends of the arms (53) are slowly lifted and the seats (51) are raised high above. Then the audiences feel more exciting and like flying in the air as the mounting shafts (52) along with the seats (51) swing according to the stories of the movies.

However, the conventional motion simulators (50) as described are limited to motions and do not realistically simulate motion types of reality. Furthermore, the heavy weight of the audiences and the seats (51) deform the mounting shaft (52) and the audiences are in danger of falling off. If sizes of the mounting shafts (52) are enlarged to strengthen the mounting shafts (52), more energy are needed to drive the motion simulators (50).

To overcome the shortcomings, the present invention provides a motion simulator to mitigate or obviate the aforementioned problems.

SUMMARY OF THE INVENTION

The main objective of the present invention is to provide a motion simulator. The motion simulator has a motive device suspended in midair and a seat assembly. The motive device has a base, a moving panel, twelve universal joints being mounted on the base and the moving panel and six actuators being connected to the universal joints and retractable. The seat assembly is hung on the moving panel.

Therefore, as the actuators retract, the moving panel and the seat assembly are moved in six degrees of freedom such as heave, sway, surge, pitch, roll and yaw. Audiences sitting on the seat assembly are hung with their feet hanging in the air and therefore feel excited and experience a vivid virtual reality. Moreover, the actuators bear axial force such as drag force and thrust force and are endurable and safe.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
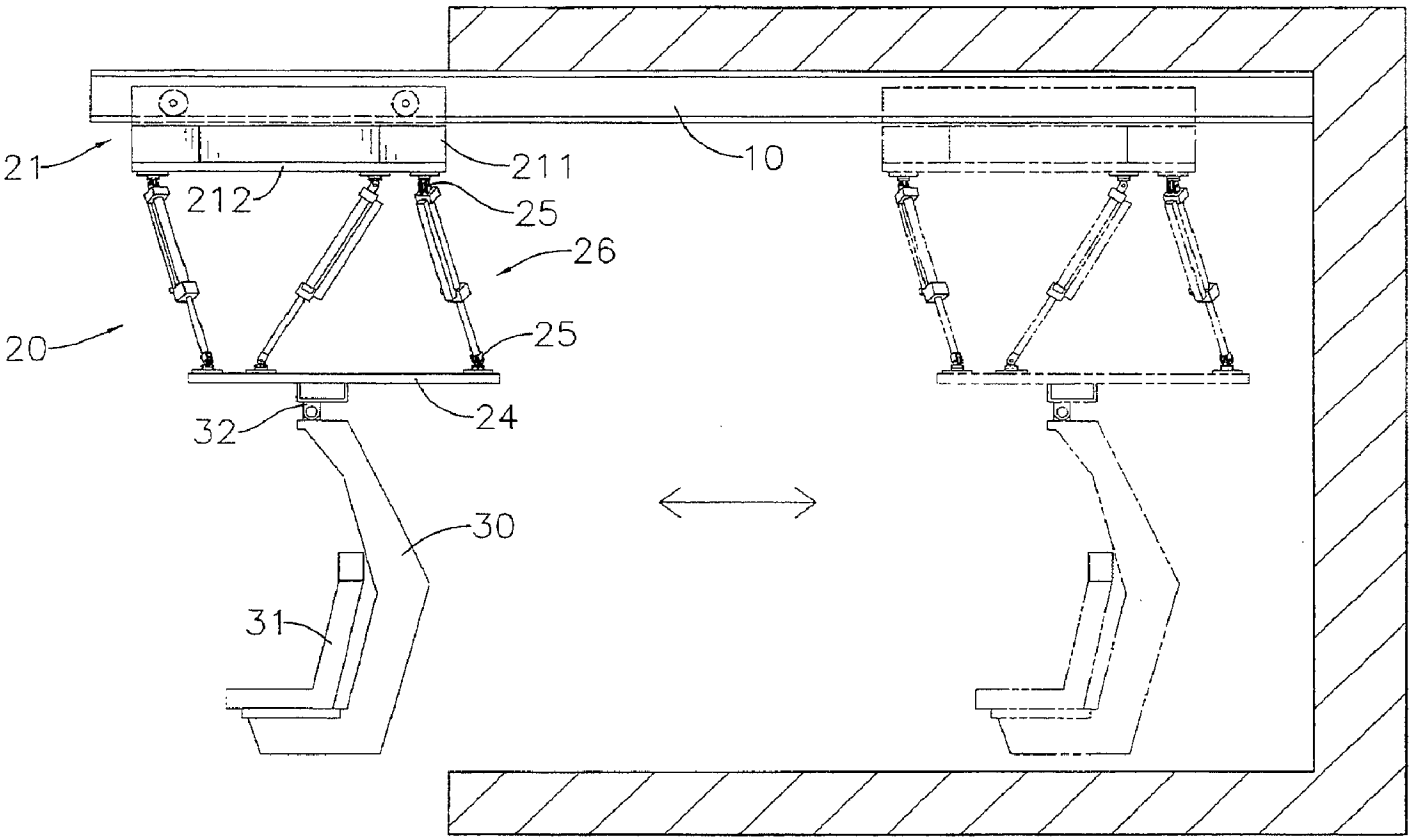
FIG. 1 is a side view of a motion simulator in accordance with the present invention, showing wheels in phantom lines.
Figure 2:
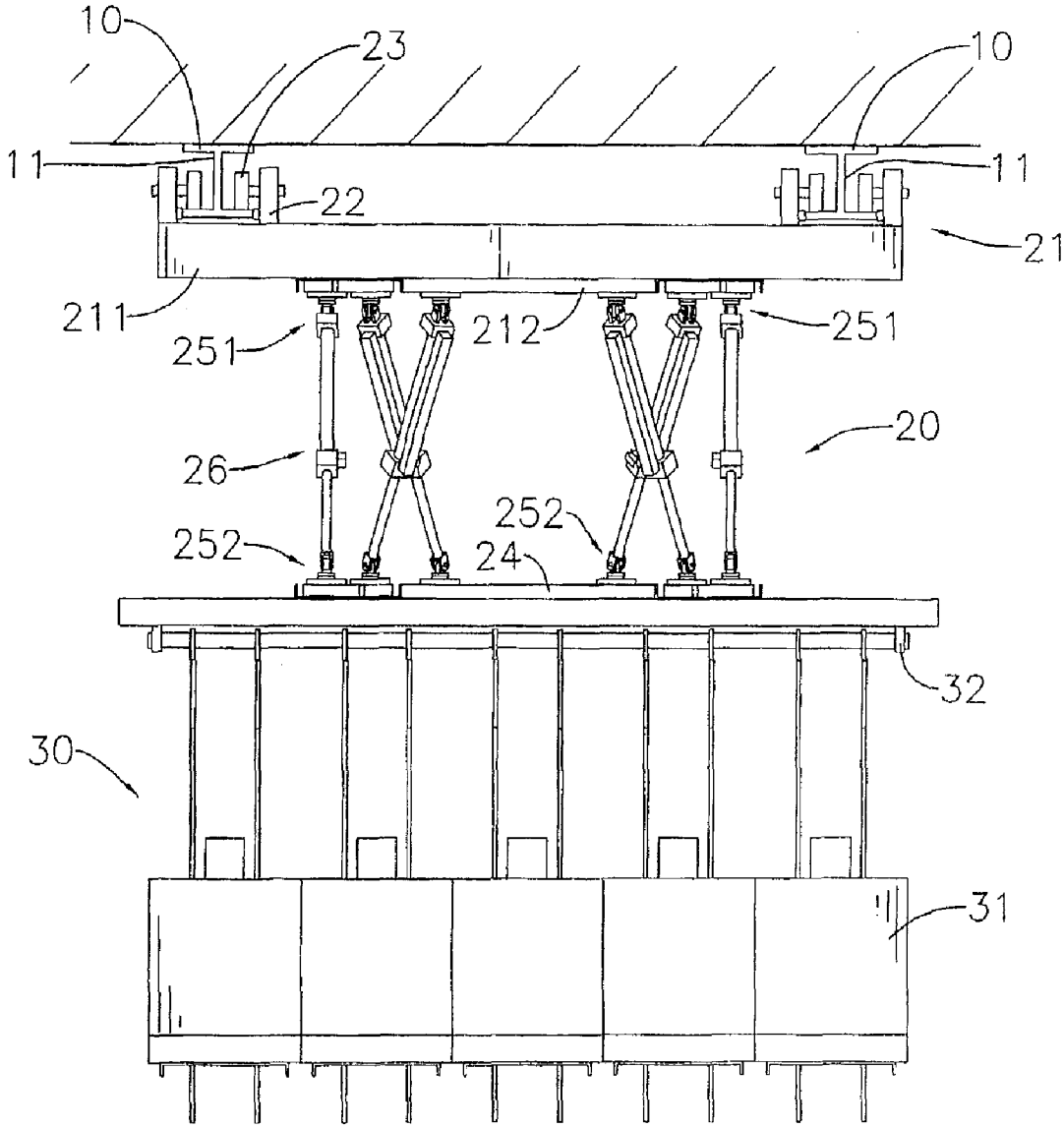
FIG. 2 is a front view of the motion simulator in FIG. 1.
Figure 7:
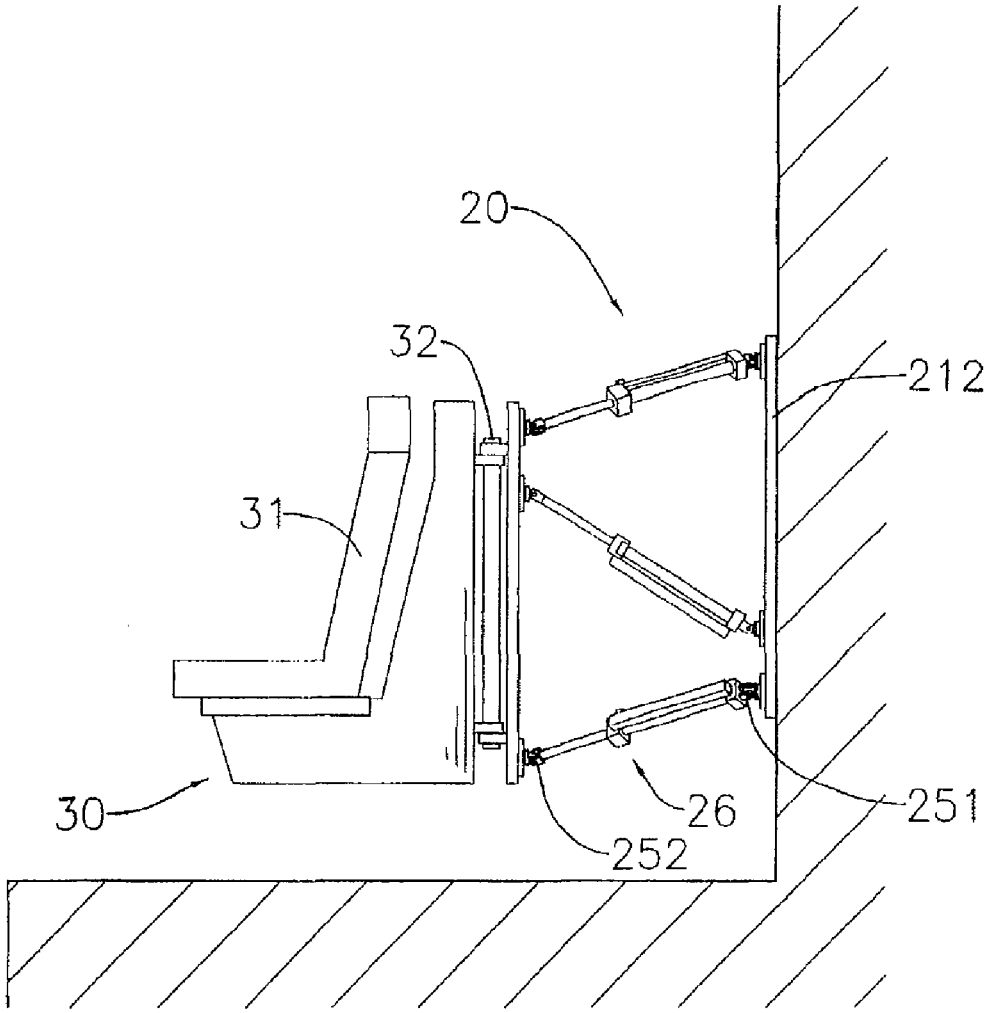
FIG. 7 is an operational side view of another embodiment of a motion simulator in accordance with the present invention.

With reference to FIGS. 1, 2 and 7, a motion simulator in accordance with the present invention comprises two optional tracks (10), a motive device (20) and a seat assembly (30).

The tracks (10) are separately, parallelly and securely attached to a ceiling of a theater. Each track (10) is I-shaped in cross-section and has two opposite side surfaces and two guiding recesses (11). The guiding recesses (11) are respectively formed in the side surfaces of the track (10).

Figure 3:
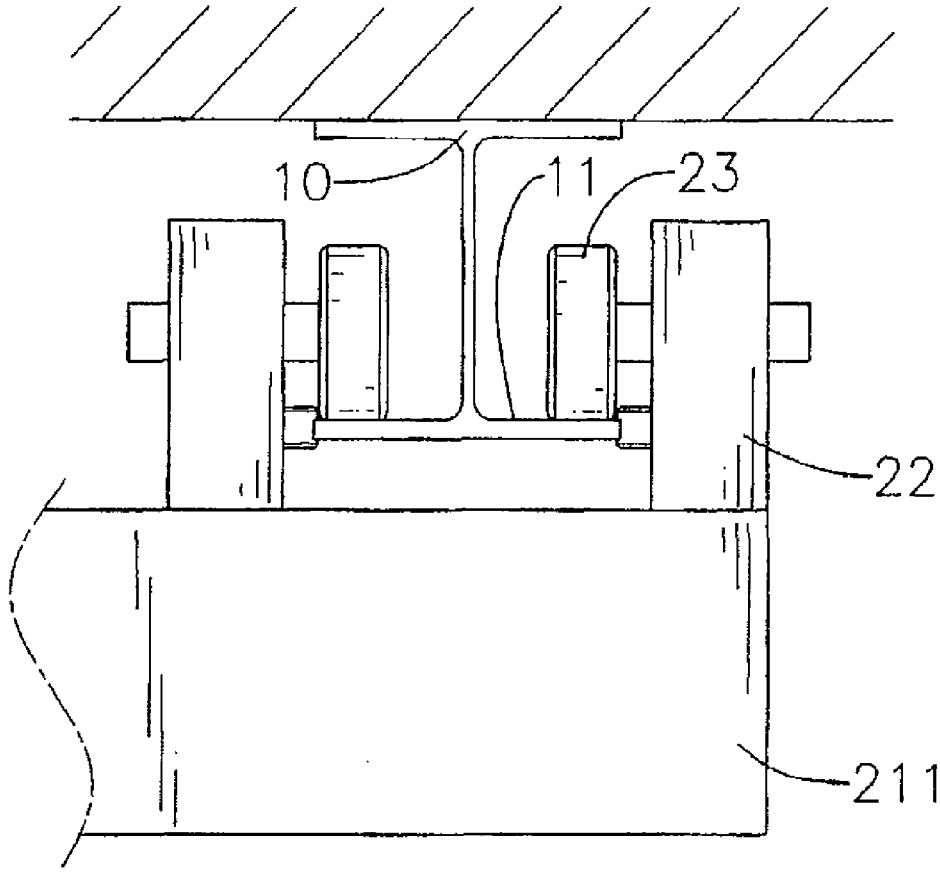
FIG. 3 is an enlarged front view of a sliding device and a track of the motion simulator in FIG. 1.

With further reference to FIG. 3, the motive device (20) is suspended in midair, may be slidably mounted on the tracks (10), may be controlled by a controller to slide along the tracks (10), may be attached to a wall and has a base (21), multiple optional wheel mounts (22), multiple optional wheels (23), a moving panel (24), twelve universal joints (25, 25', 25") and six actuators (26).

The base (21) may be mounted adjacent to the tracks (10), has an upper surface, a mounting surface and two opposite sides and may comprise a mounting panel (211) and a stationary panel (212). The sides of the base (21) respectively correspond to and parallel the tracks (10). The mounting panel (211) has an upper surface, a lower surface and two opposite sides. The sides of the mounting panel (211) respectively correspond to and are parallel the tracks (10). The stationary panel (212) is securely attached to the mounting panel (211), may be attached to the wall and has a connecting surface and a mounting surface. The connecting surface of the stationary panel (212) is securely attached to the lower surface of the mounting panel (211).

The wheel mounts (22) are mounted on the upper surface of base (21) and adjacent to the sides of the base (21), may be mounted on the upper surface of the mounting panel (211) and adjacent to the sides of the mounting panel (211). Each two wheel mounts (22) are adjacent to each other and are parallel with a corresponding track (10). Each wheel mount (22) of the two adjacent wheel mounts (22) corresponds to one guiding recess (11) of the corresponding track (10).

The wheels (23) are respectively and rotatably mounted on the wheel mounts (22). Each wheel (23) is rotatably placed in a corresponding guiding recess (11) of the corresponding track (10) to allow the motive device (20) to slide along the tracks (10).

The moving panel (24) is interacted with the base (21), may be placed under the stationary panel (212) and has a mounting surface and a connecting surface. The mounting surface of the moving panel (24) corresponds to the mounting surface of the base (21) and may correspond to the mounting surface of the stationary panel (212).

Figure 4:
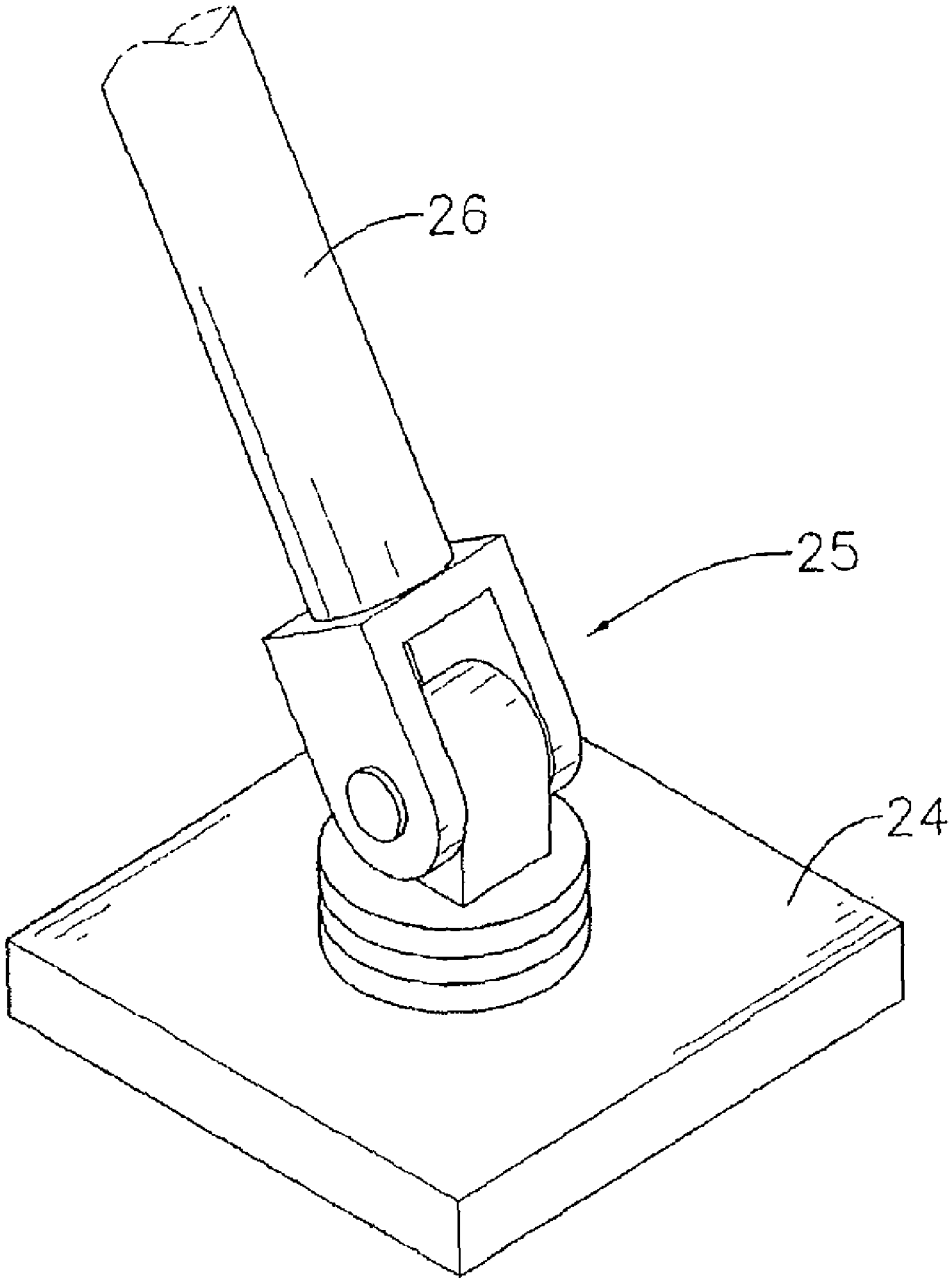
FIG. 4 is an enlarged perspective view of a first embodiment of a universal joint of the motion simulator in FIG. 1.
Figure 5:
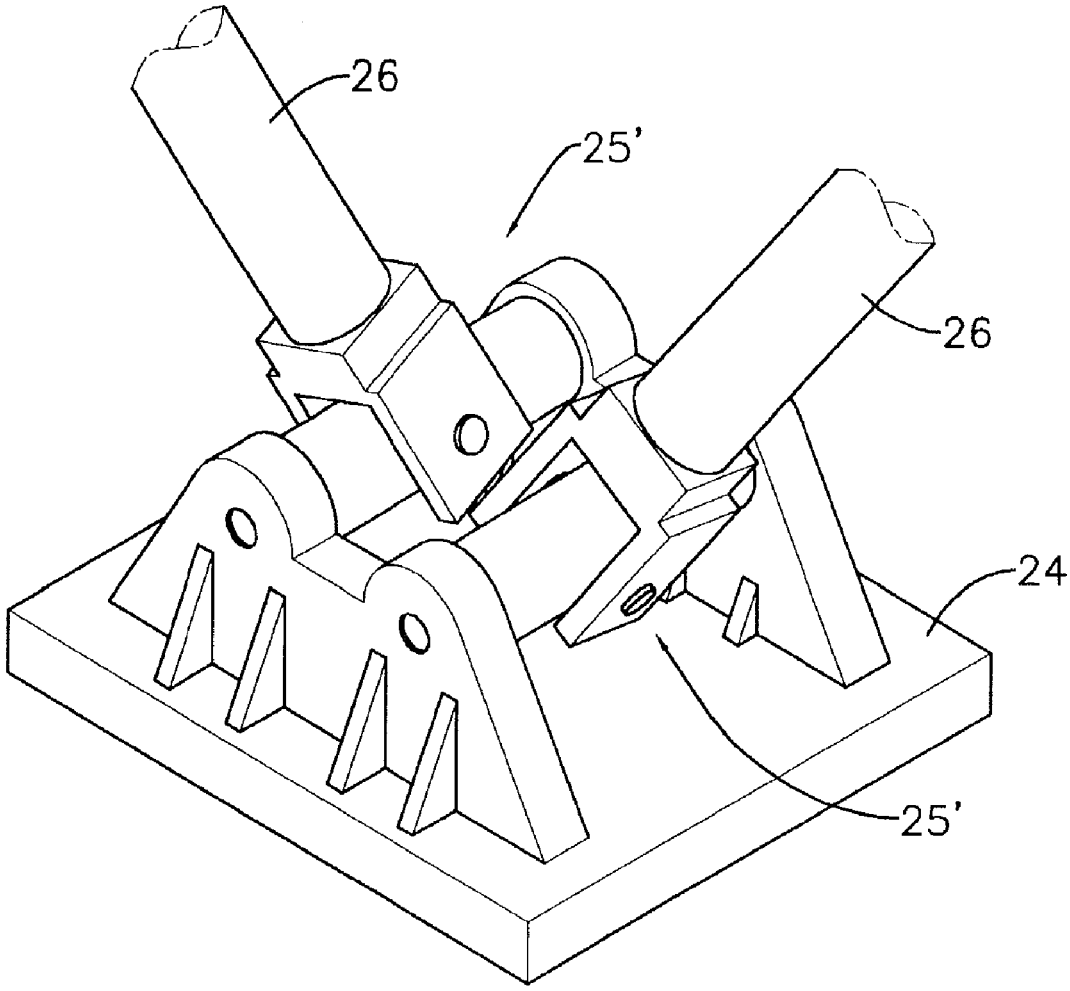
FIG. 5 is an enlarged perspective view of a second embodiment of a universal joint of the motion simulator in FIG. 1.
Figure 6:
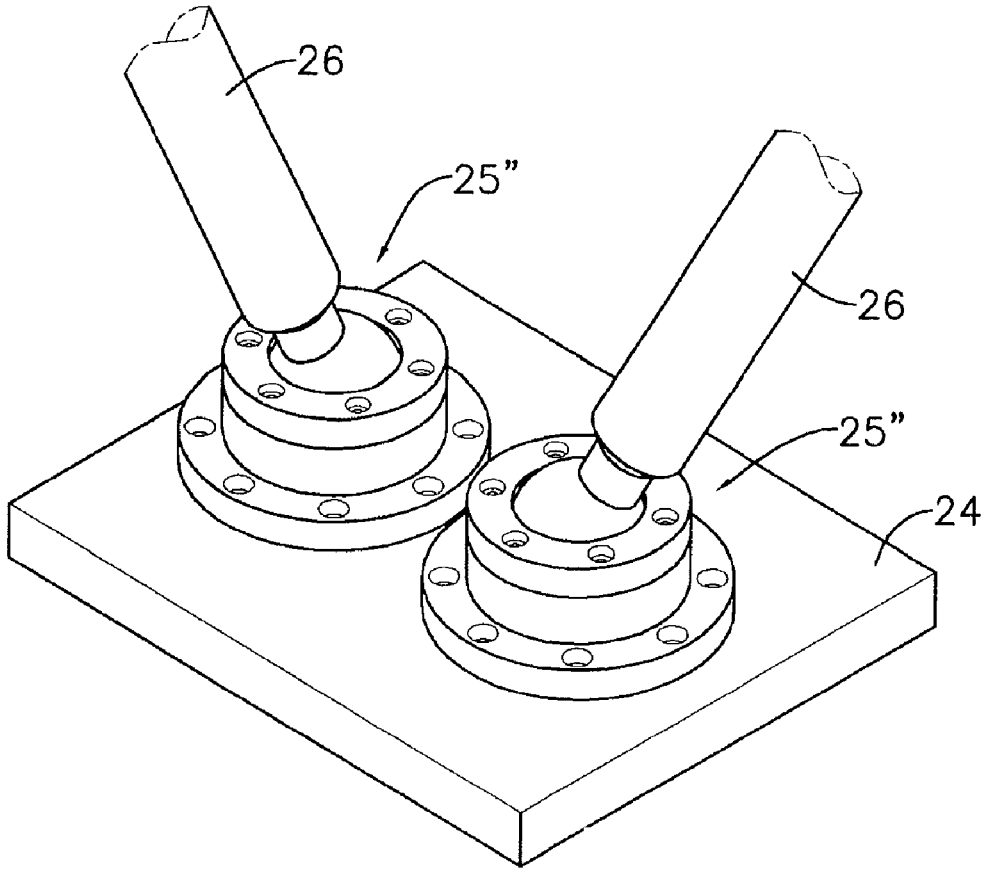
FIG. 6 an enlarged perspective view of a third embodiment of a universal joint of the motion simulator in FIG. 1.

With further reference to FIGS. 4 to 6, the universal joints (25, 25', 25") are mounted on the mounting surfaces of the base (21) and the moving panel (24), may be mounted on the mounting surfaces of the stationary panel (211) and the moving panel (24), may be cross-typed universal joints (25') or ball-typed universal joints (25") and comprises six upper universal joints (251) and six lower universal joints (252). The upper universal joints (251) are mounted on the mounting surface of the base (21), may be mounted on the mounting surface of the stationary panel (211). Each two upper universal joints (251) are adjacent to and misalign with each other. The lower universal joints (252) are mounted on the mounting surface of the moving panel (24). Each two lower universal joints (252) are adjacent to and misalign with each other and misalign with the upper universal joints (251) while the moving panel (24) parallels the base (21).

The actuators (26) are connected respectively to the universal joints (25, 25', 25"), are controlled by the controller and may be hydraulic, pneumatic or electromechanical. Each actuator (26) is retractable and has a stationary end and a moving end. The stationary end of the actuator (26) is connected to the corresponding upper universal joint (251). The moving end of the actuator (26) is connected to the corresponding lower universal joint (252). Therefore, as the actuators (26) respectively retract, the moving panel (24) is oriented in different positions and heaves, sways, surges, pitches, rolls and yaws relative to the base (21).

The seat assembly (30) is hung on the moving panel (24) of the motive device (20) for audiences to sit on the seat assembly (30) with their feet hanging in the air and to heave, sway, surge, pitch, roll and yaw with the motive device (20), may be pivotally connected to the motive device (20) and has at least one seat (31) and an optional connector (32). Each one of the at least one seat (31) is hung on the moving panel (24) and has a top and a back. The connector (32) is mounted between the at least one seat (31) and the connecting surface of the moving panel (24), is pivotally connected to the at least one seat (31), is controlled by the controller. The connector (32) may be mounted transversely between the top of the at least one seat (31) and the connecting surface of the moving panel (24) for the audiences to further pitch relative to the motive device (20) or may be mounted longitudinally between the back of the at least one seat (31) and the connecting surface of the moving panel (24) for the audiences to further yaw relative to the motive device (20).

Figure 8:
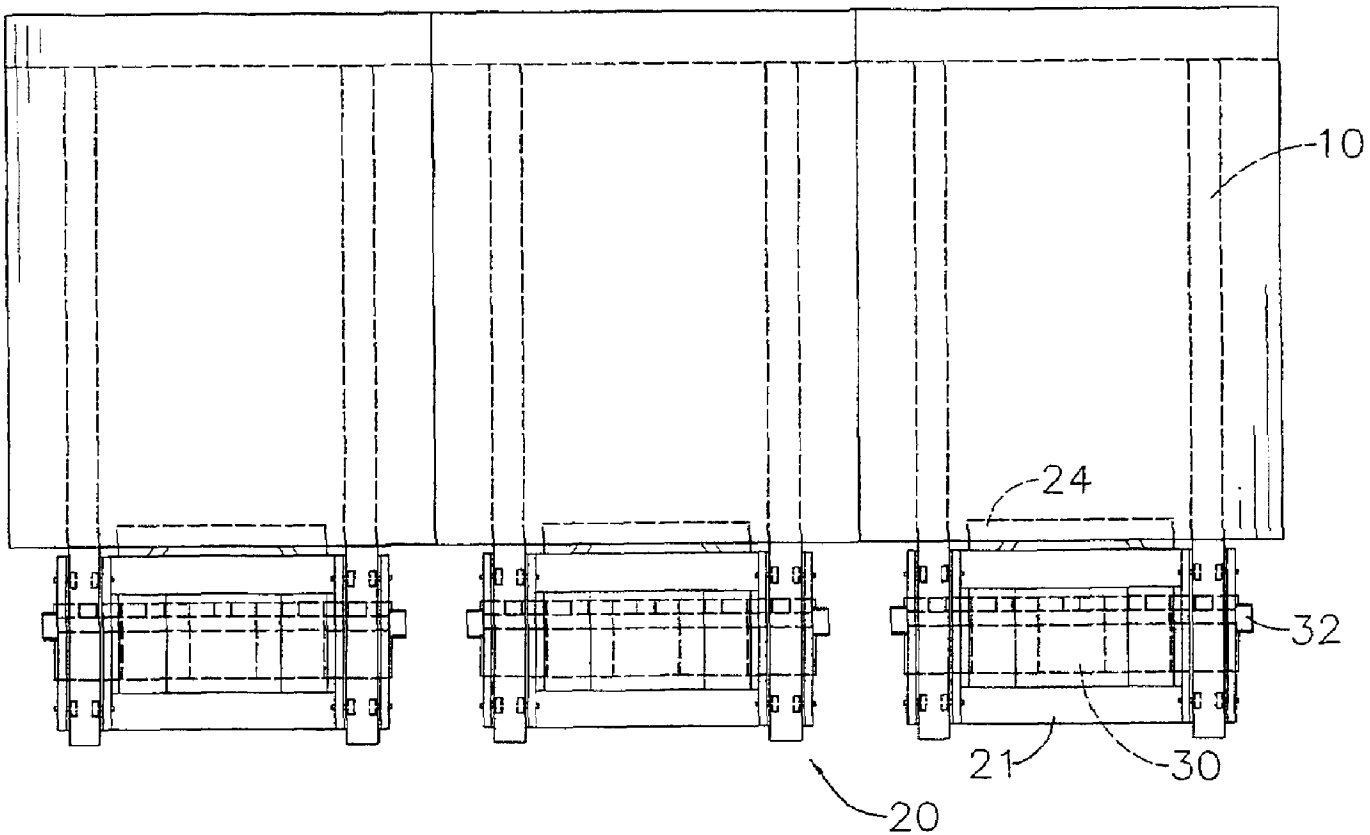
FIG. 8 is an operational top view of the motion simulator in FIG. 1, showing the motion simulators being arranged in a line.

With further reference to FIG. 8, multiple motion simulators as described may be parallelly arranged in the theater. The controllers move the motive devices (20) of the motion simulators to inner ends of the tracks (10) for the audiences to ride on the seat assemblies (30) and move the motive devices (20) toward outer ends of the tracks (10) to approach a projection screen in the theater and to hang the audience high with their feet hanging in the air. Then the actuators (26) retract according to stories of the movies and the audiences feel like being in the movies and experience virtual reality.

Figure 9:
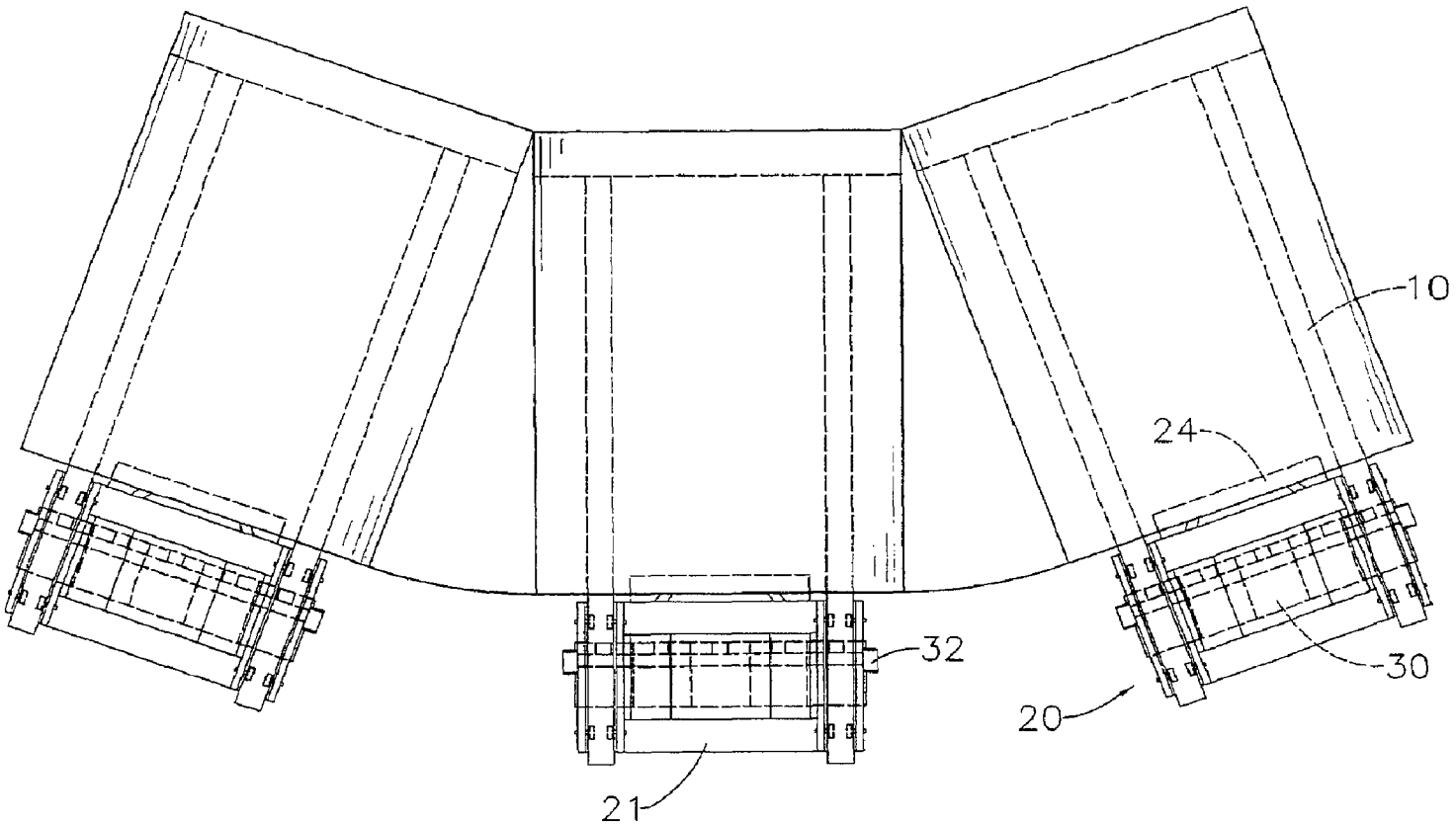
FIG. 9 is another operational top view of the motion simulator in FIG. 1, showing the motion simulators being arranged in an arc.

With further reference to FIG. 9, as the inner ends of two adjacent motion simulators as described approach each other and the outer ends of the two adjacent motion simulators apart from each other, the motion simulators are arranged fan-shaped in the theater.

Figure 10:
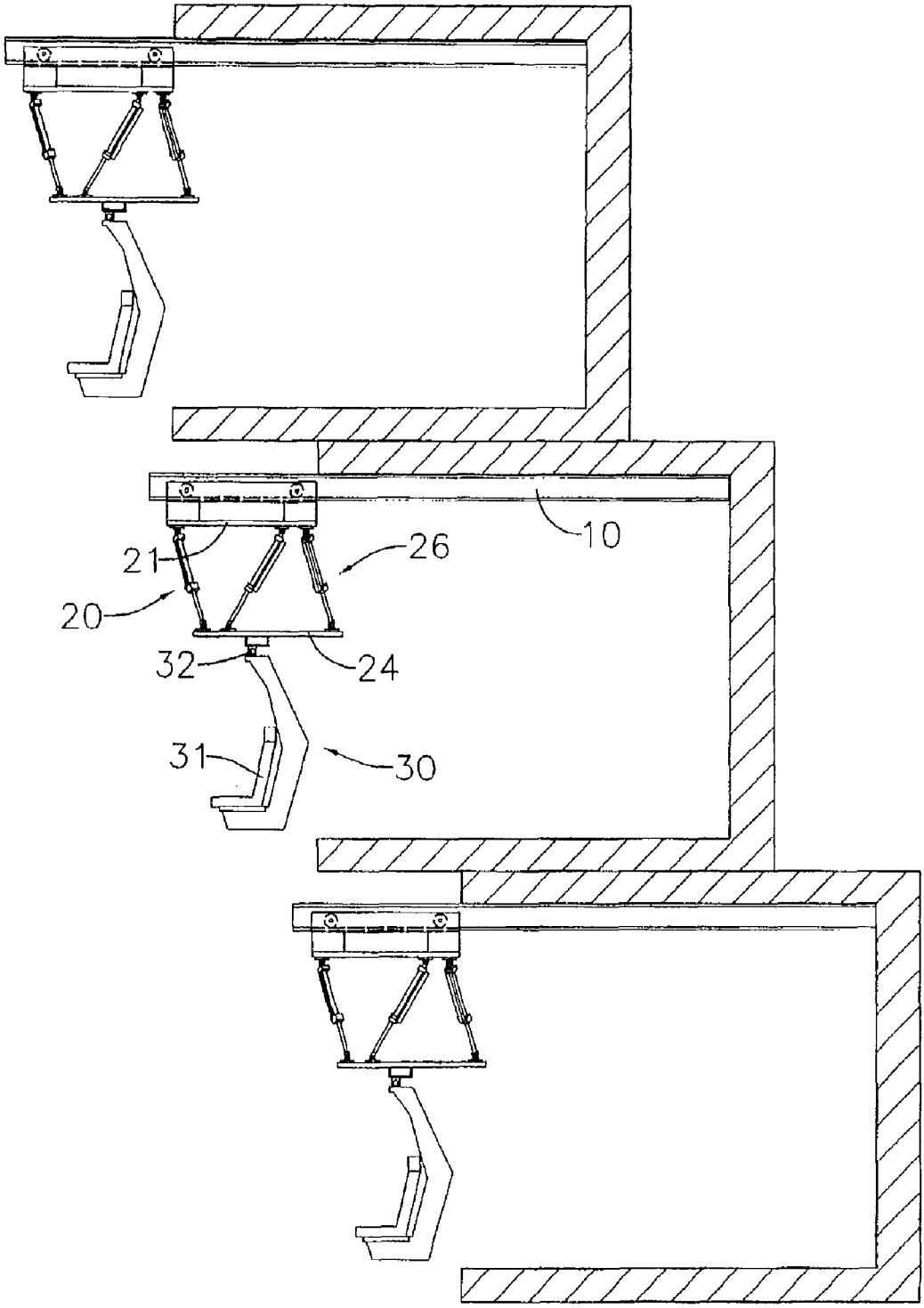
FIG. 10 is another operational top view of the motion simulator in FIG. 1, showing the motion simulators being arranged in different heights.
Figure 11:
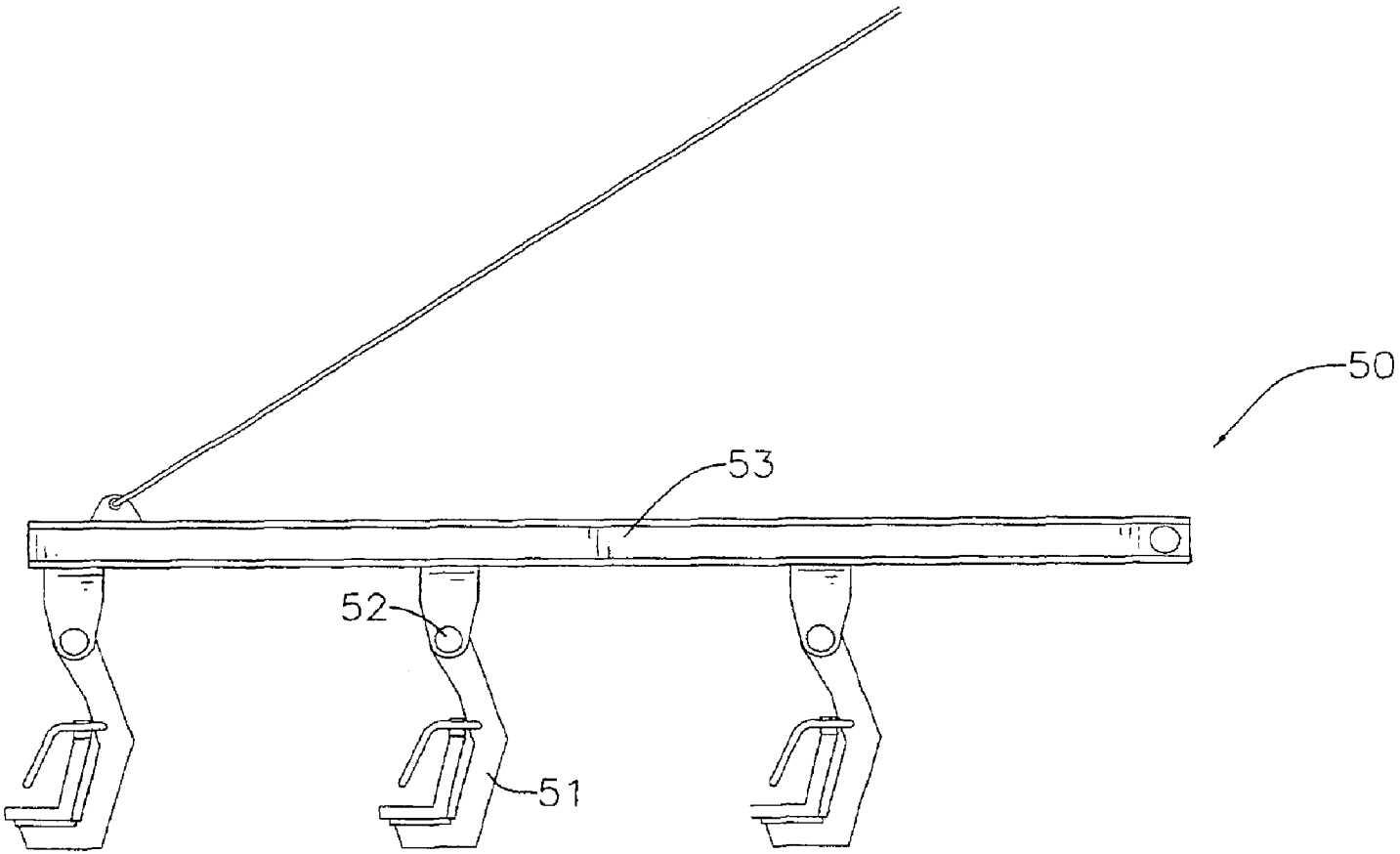
FIG. 11 PRIOR ART
FIG. 11 is a side view of a conventional motion simulator in accordance with the prior art.
Figure 12:
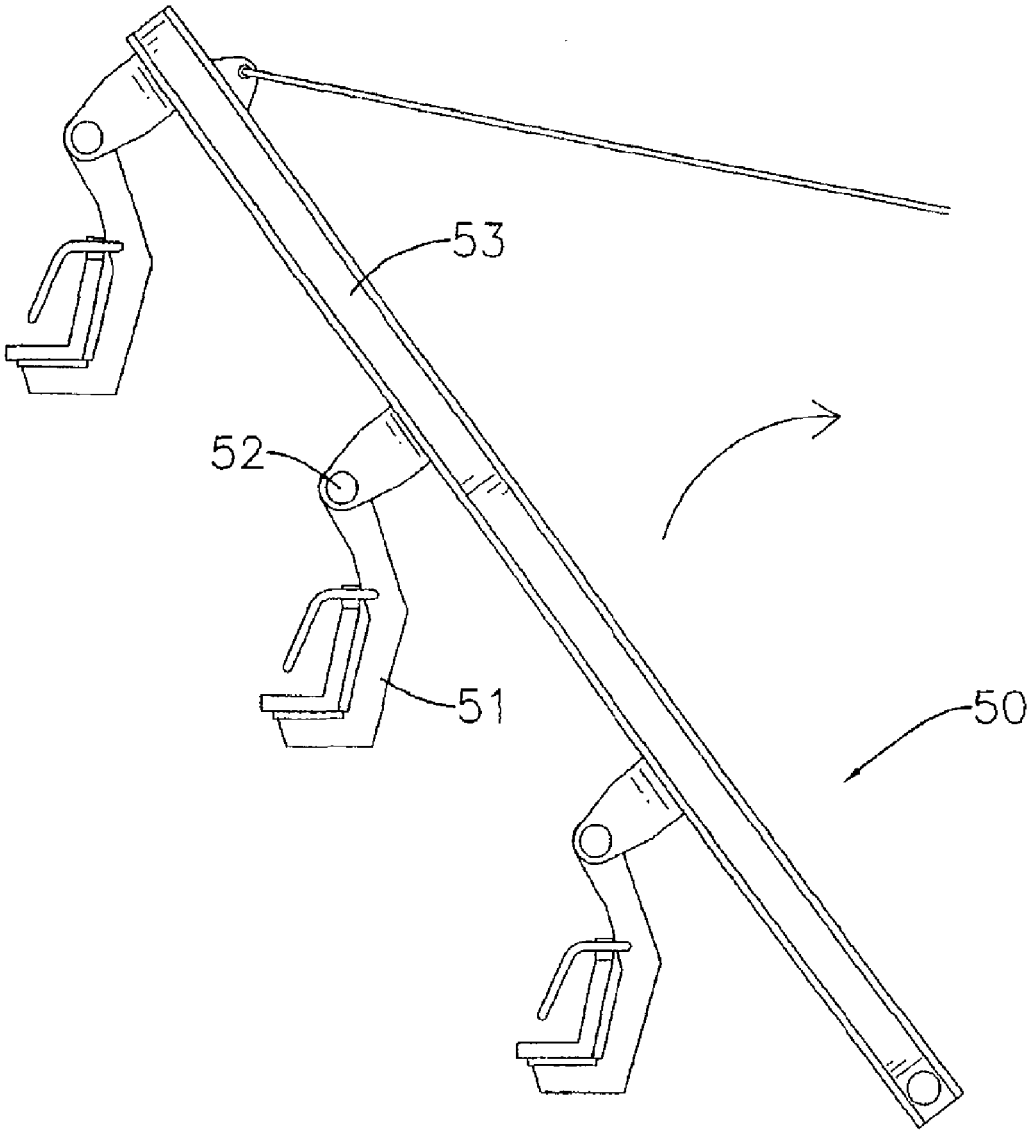
FIG. 12 PRIOR ART
FIG. 12 is an operational side view of the conventional motion simulator in FIG. 10, showing seats of the motion simulator being lifted.

With further reference to FIG. 10, the parallel arranged motion simulators as described and the fan-shaped arranged motion simulators as described may be further mounted in different heights in the theater. Thus, the higher the motion simulators as described are set, the more excited the audiences get.

The motion simulator as described has the following advantages. The actuators (26) drive the seat assembly (30) to move nimbly in six degrees of freedom such as heave, sway, surge, pitch, roll and yaw. Therefore, the audiences sitting on the seat assembly (30) feel excited and experience a real virtual reality than ever. Moreover, the actuators (26) retract, bear axial force such as dragging force and thrust force and are much more endurable and safety.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A motion simulator comprising:

a motive device being suspended and having a base having a mounting surface;

a moving panel being interacted with the base and having a mounting surface corresponding to the mounting surface of the base; and a connecting surface;

twelve universal joints being mounted on the mounting surfaces of the base and the moving panel and comprising six upper universal joints being mounted on the mounting surface of the base, and each two upper universal joints being adjacent to and misaligning with each other; and six lower universal joints being mounted on the mounting surface of the moving panel, and each two lower universal joints being adjacent to and misaligning with each other and misaligning with the upper universal joints while the moving panel paralleling the base; and six actuators being connected respectively to the universal joints, and each actuator being retractable and having a stationary end being connected to the corresponding upper universal joint; and a moving end being connected to the corresponding lower universal joint; and a seat assembly pivotally hung on the moving panel of the motive device for audiences to sit on the seat assembly with their feet hanging in the air.

2. The motion simulator as described in claim 1, further comprising two tracks being separately and securely attached to a ceiling and parallel to each other, each track being I-shaped in cross-section and having two opposite side surfaces; and two guiding recesses being respectively formed in the side surfaces of the track, wherein the base of the motive device is mounted adjacent to the tracks and further has an upper surface; and two opposite sides respectively corresponding to and paralleling the tracks, and wherein the motive device is slidably mounted on the tracks and further has multiple wheel mounts being mounted on the upper surface of the base and adjacent to the opposite sides of the base, each two wheel mounts being adjacent to each other and being parallel with a corresponding track, and each of the two adjacent wheel mounts corresponding to one guiding recess of the corresponding track; and multiple wheels being respectively and rotatably mounted on the wheel mounts, each wheel being rotatably placed in a corresponding guiding recess of the corresponding track.

3. The motion simulator as claimed in claim 2, wherein the base of the motive device comprises a mounting panel having an upper surface;

a lower surface; and two opposite sides respectively corresponding to and being parallel with the tracks; and a stationary panel being securely attached to the mounting panel and having a connecting surface being securely attached to the lower surface of the mounting panel; and a mounting surface, the wheel mounts of the motive device are mounted on the upper surface of the mounting panel and adjacent to the opposite sides of the mounting panel, the moving panel of the motive device is placed under the stationary panel, the mounting surface of the moving panel corresponds to the mounting surface of the stationary panel, the universal joints are mounted on the mounting surfaces of the stationary panel and the moving panel, and the upper universal joints are mounted on the mounting surface of the stationary panel.

4. The motion simulator as claimed in claim 1, wherein the seat assembly is connected to the motive device and has at least one seat, each one of the at least one seat being hung on the moving panel; and a connector being mounted between the at least one seat and the connecting surface of the moving panel and being pivotally connected to the at least one seat.

5. The motion simulator as claimed in claim 4, wherein each seat of the seat assembly has a top, and the connector of the seat assembly is mounted transversely between the top of the at least one seat of the seat assembly and the connecting surface of the moving panel.

6. The motion simulator as claimed in claim 4, wherein each seat of the seat assembly has a back, and the connector of the seat assembly is mounted longitudinally between the back of the at least one seat of the seat assembly and the connecting surface of the moving panel.

7. The motive device as claimed in claim 1, wherein the universal joints are cross-typed universal joints.

8. The motive device as claimed in claim 1, wherein the universal joints are ball-typed universal joints.

9. The motive device as claimed in claim 1, wherein the actuators are hydraulic.

10. The motive device as claimed in claim 1, wherein the actuators are pneumatic.

11. The motive device as claimed in claim 1, wherein the actuators are electromechanical.

* * * * *